US006161412A

United States Patent [19]

Hogg et al.

[11] Patent Number: 6,161,412

[45] Date of Patent: Dec. 19, 2000

[54] MULTI-STRAND FINISHING BLOCK

[76] Inventors: James Trevor Hogg, 327 Crimicar Lane, Sheffield S10 4EN, United Kingdom; Ryo Sato; Akiro Sakai, both of c/o NKK Corporation, 1-2 Marunouchi 1-chome, Chiyoda-ku, Tokyo 100, Japan

[21] Appl. No.: 08/817,870

[22] PCT Filed: Nov. 2, 1995

[86] PCT No.: PCT/GB95/02565

§ 371 Date: Nov. 10, 1997

§ 102(e) Date: Nov. 10, 1997

[87] PCT Pub. No.: WO96/14174

PCT Pub. Date: May 17, 1996

[30] Foreign Application Priority Data

Nov. 7, 1994 [GB] United Kingdom ..... 9422451

[51] Int. Cl.[7] ..... B21B 13/12

[52] U.S. Cl. ..... 72/235; 72/234; 72/226; 72/228

[58] Field of Search ..... 72/234, 235, 226, 72/227, 228, 231, 222, 233

[56] References Cited

U.S. PATENT DOCUMENTS 5,307,663 5/1994 Shore et al. ..... 72/235

FOREIGN PATENT DOCUMENTS 1128157 9/1968 United Kingdom .

*Primary Examiner*—Joseph J. Hail, III
*Assistant Examiner*—Rodney Butler

[57] ABSTRACT

A multi-strand finishing block finishes two or more daughter strands slit from a parent bar. Each strand is rolled by at least two pairs of rolls arranged in tandem with the rolls of each pair being at right angles to the rolls of the other pair. A common drive shaft is in driving relation with all the pairs of rolls.

3 Claims, 5 Drawing Sheets

MULTI-STRAND FINISHING BLOCK

The present invention is concerned with the production of bar stock, especially steel bar stock, and in particular the invention is concerned with the finishing of daughter bars of reduced cross-section formed by slitting a parent bar longitudinally.

It is known to slit a parent bar into two (or more) daughter bars for subsequent finishing treatment in separate finishing lines.

Figure 1:
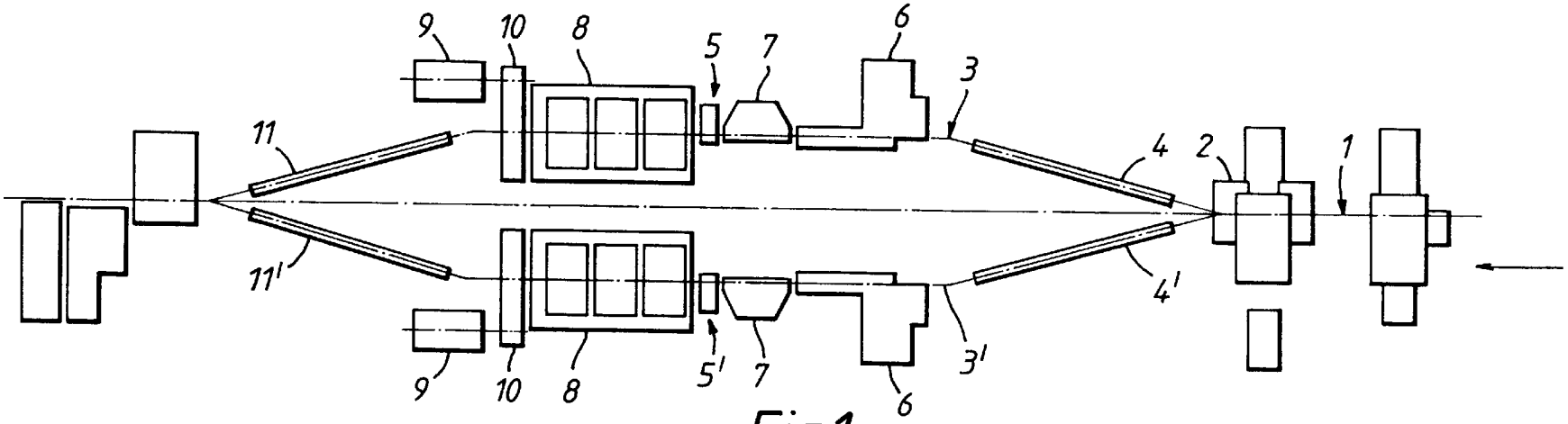

FIG. 1 of the accompanying drawings is a plan view of a prior art twin strand finishing line. The parent bar 1 is moved in the direction of its length, along a path as indicated by the arrow, through the last stand of the intermediate mill. On exiting the last intermediate stand the bar passes through a slitter 2 which slices the parent bar in the direction of its length into two daughter bars 3, 3'. The daughter bars 3', 3 are also referred to as strands. The daughter strands pass along separate finishing lines 5 and 5' which include separate diverging guide tubes 4, 4. Each finishing line also includes a crop shear 6, a side looper 7 and a multi-stand finishing block 8. As shown in FIG. 1, each finishing block comprises three stands arranged in tandem and driven from a common drive motor 9 through a gearbox 10. Each motor 9 is located outside of the corresponding finishing line 5.

Downstream of the finishing blocks 8 the reduced daughter strands are passed through separate converging guide tubes 11, 11' and then continue side-by-side adjacent the original longitudinal path for further treatment. When it is desired to produce strands of larger cross-section than that of the daughter strands, the parent bar may be routed directly along the longitudinal path between the finishing lines, bypassing the finishing blocks. A conveyor, not shown, is provided for this purpose.

The prior art twin strand finishing line shown in FIG. 1, suffers the disadvantage of requiring duplication of the drive for each of the finishing blocks and because the drives are separate it is necessary to be able to adjust the speed of one finishing block relative to the other and to keep the relative speeds constant. An electronic control is usually required. The finishing blocks 8 have to be spaced apart to permit the parent bar to be passed between them when slitting is not required and the angles of divergence and convergence of the guide tubes 4 and 11 are constrained to be small. This means that the overall length of the finishing line, from the slitter to where the daughter strands come together again downstream of the guide tubes 11, is determined by the separation of the finishing lines and the angle of divergence and convergence of the guide tubes.

A reduction in the overall length of the finishing line means that the dimensions of the building which houses the finishing line can be reduced and this results in a saving in constructional costs.

Accordingly the present invention resides in a finishing block for rolling at least two strands of bar simultaneously, said block providing for each of the strands two pairs of rolls arranged in tandem with the rolls of one pair being at right angles to the rolls of the other pair characterised in the provision of a shaft having an input end and an output end with each pair of rolls being in driving relation with the shaft and the input end of the shaft being connectable to a drive motor or to, and in line with, the output end of a corresponding shaft of a similar finishing block.

In one embodiment of the invention, the strands of bar extend along three or four parallel paths spaced from and located around a further path and the axis of the drive shaft is located on the further path. When there are four paths, two of the parallel paths may be at a higher level and two of the parallel paths at a lower level than the further path.

By ensuring that a common drive is employed and particularly by arranging for the common drive to be between the parallel paths along which the strands travel, the overall size of the multi-strand finishing line can be reduced as compared with the prior art. The problem of synchronising the speeds of each of the finishing lines is also alleviated because a mechanical common drive shaft is in driving relation with all the pairs of rolls. The common drive shaft is connected by a transmission to each pair of rolls and the transmission length to each pair of rolls is kept equal so that the transmission is dynamically balanced. A motor, electric or hydraulic, is connected to the drive shaft and two or more motors connected in series may be used to drive the common drive shaft.

By bringing the finishing lines as close together as possible, guiding is made easier and the multi-strand finishing block can be made as short as possible because the lengths of the diverging and converging guide tubes can be shortened.

The present invention allows a multi-strand finishing block to have two or more strands finished simultaneously.

Figure 2:
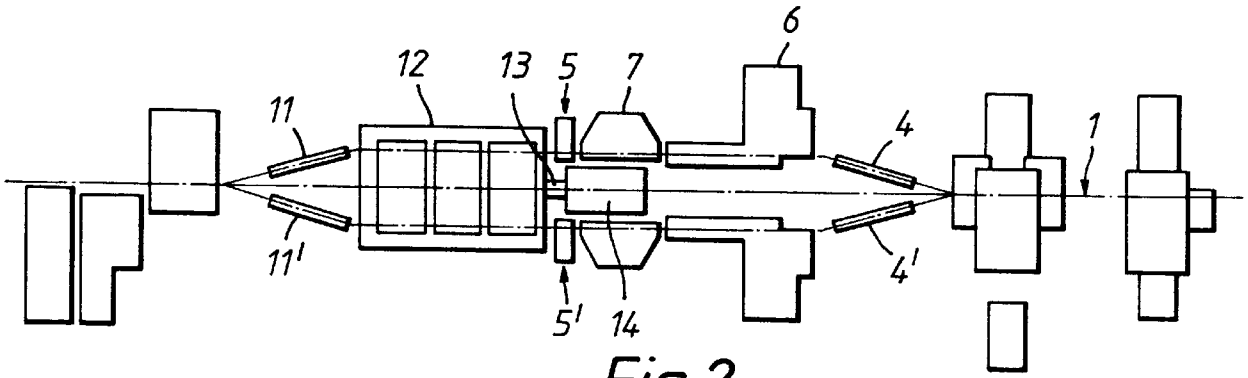
Figure 3:
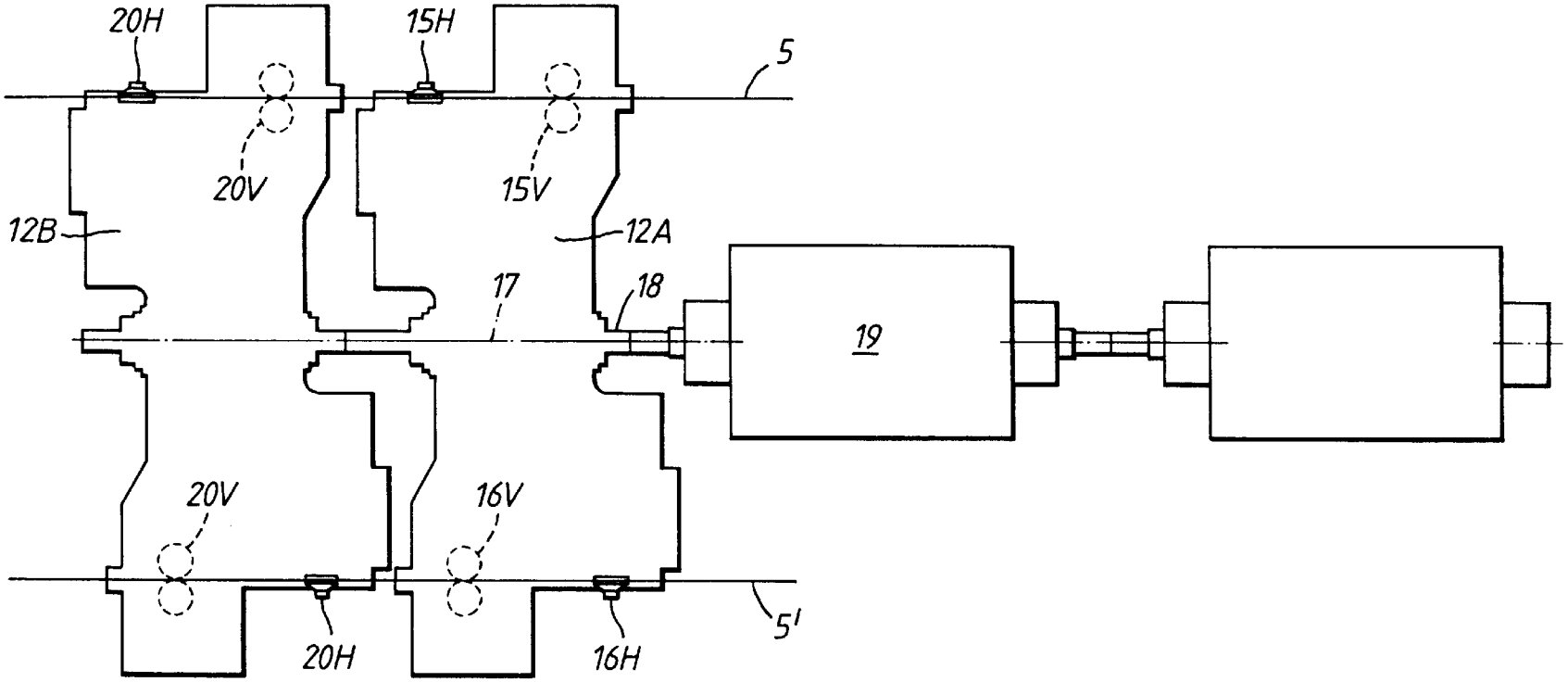
Figure 4:
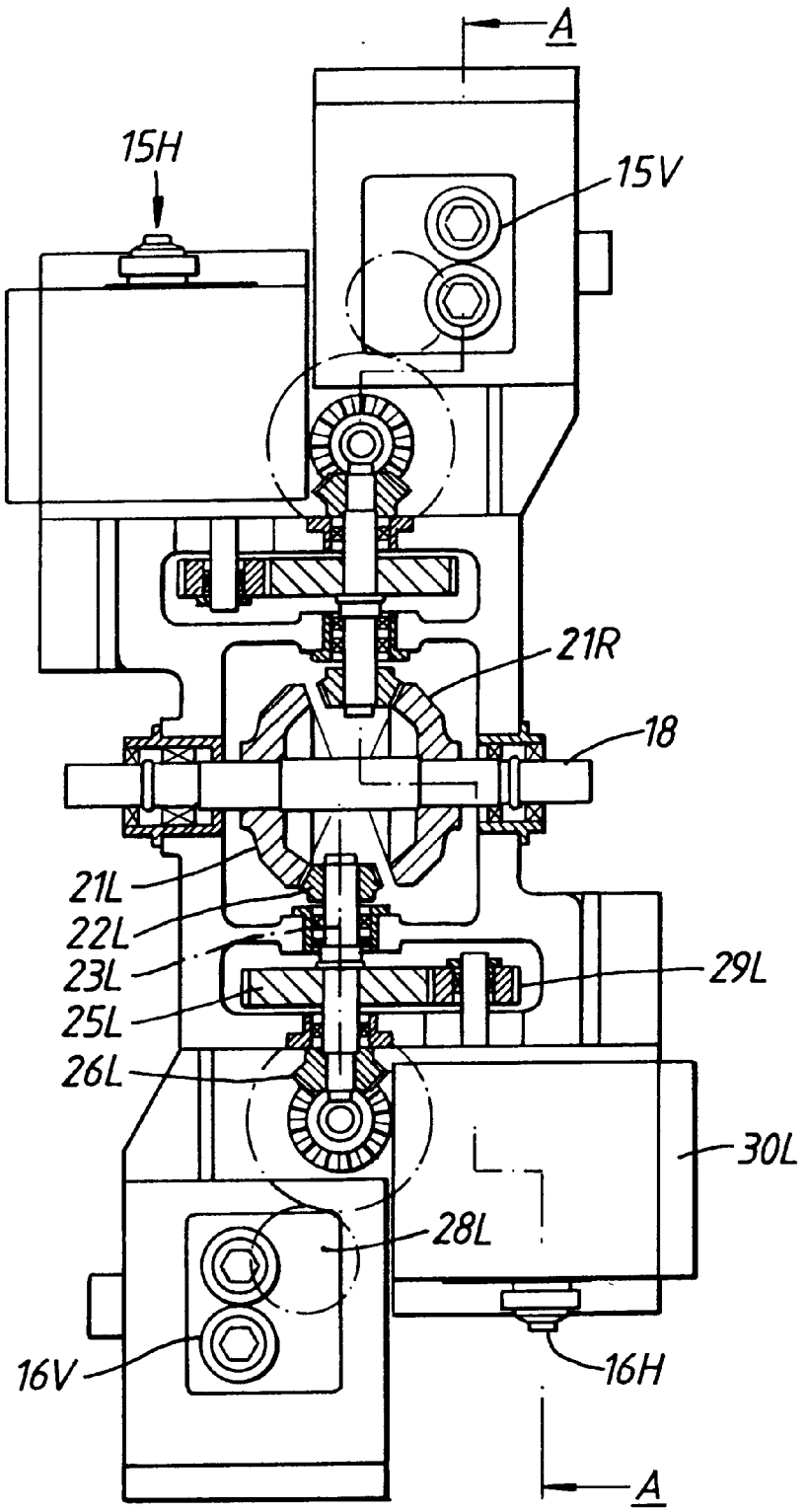
Figure 5:
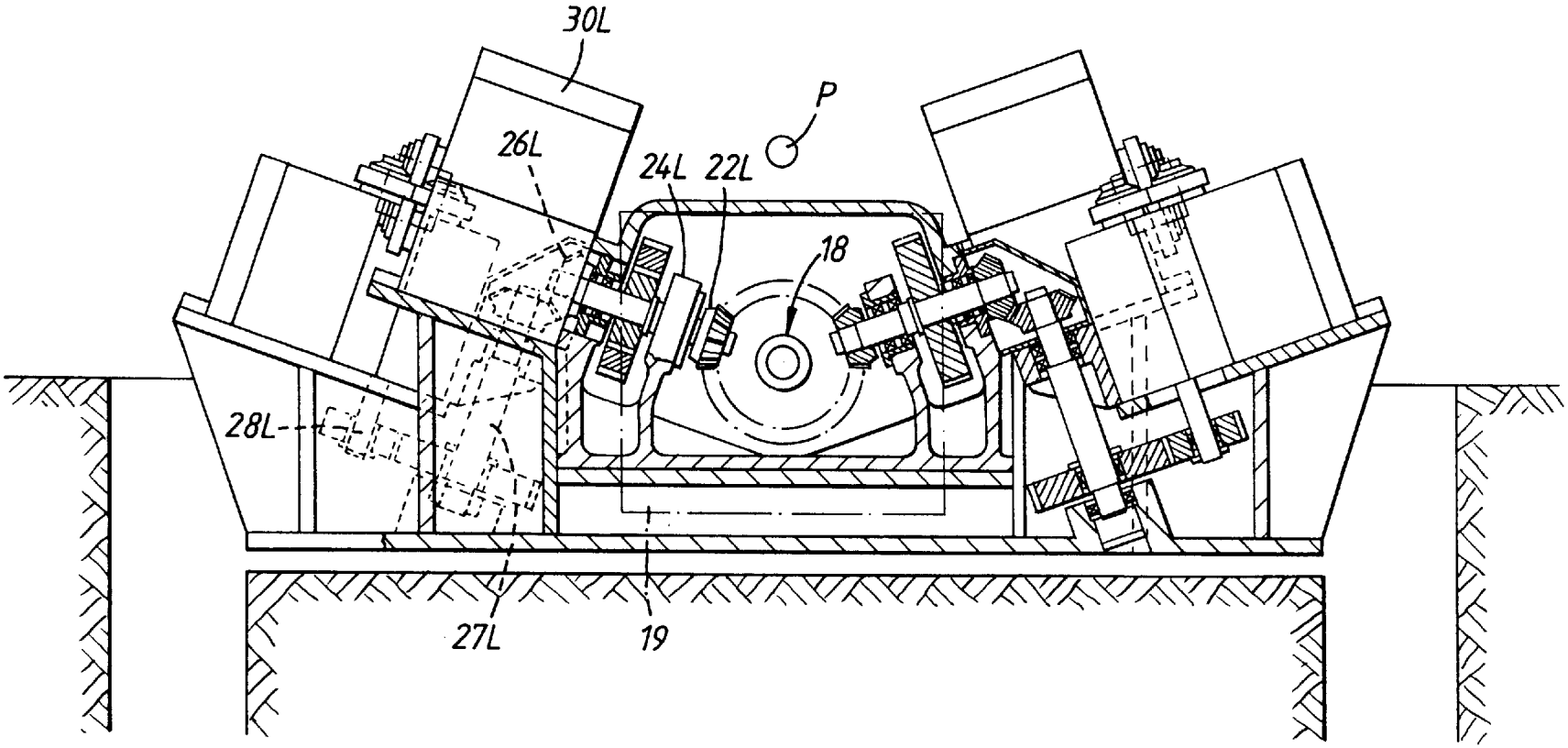
Figure 6:
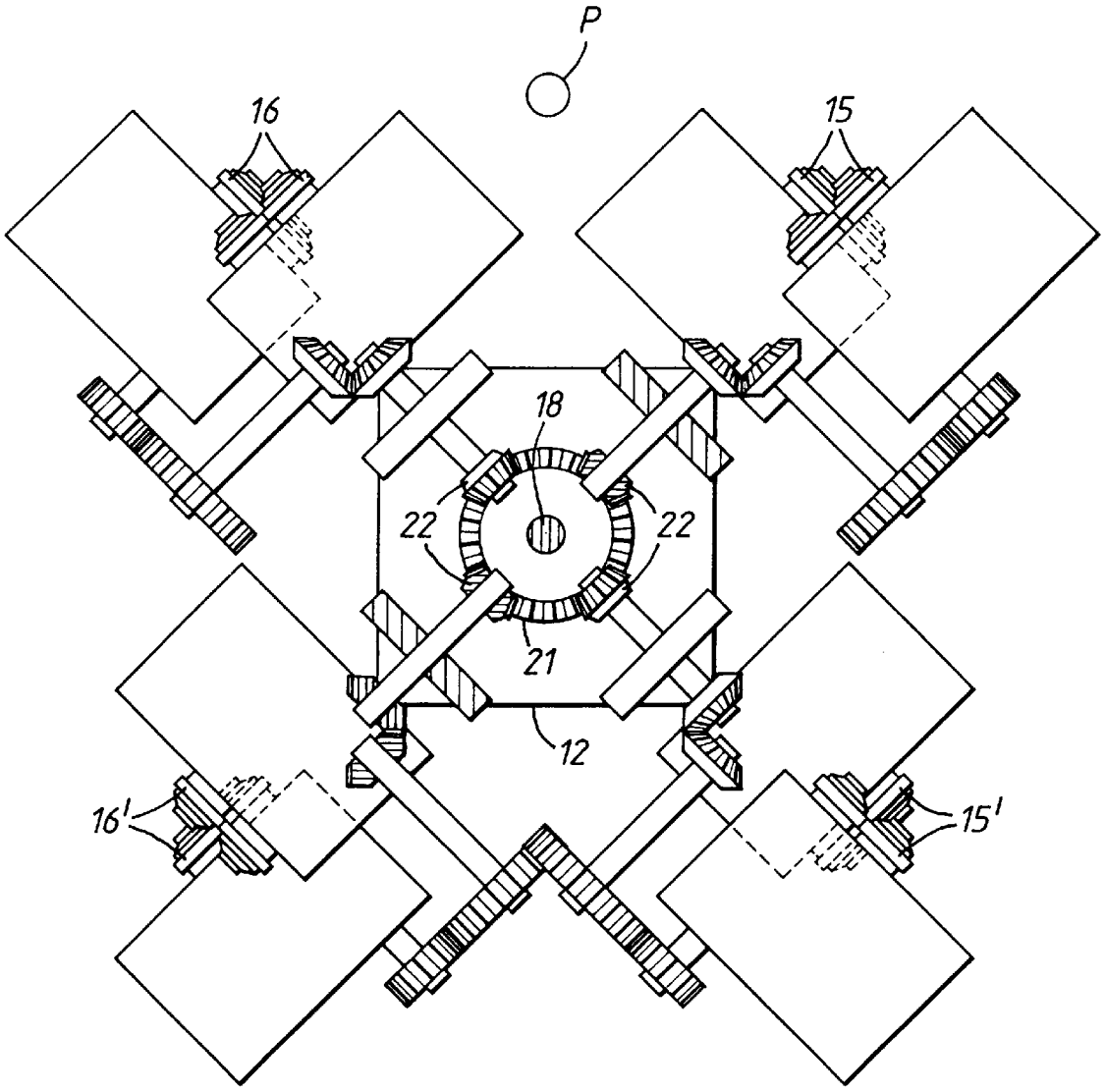

In order that the invention may be more readily understood it will now be described, by way of example only, with reference to the accompanying drawings in which:

FIG. 1 is a plan view of a prior art twin-strand finishing line,

FIG. 2 is a plan view of a twin-strand finishing line in accordance with the invention, FIG. 3 is a plan view of a twin strand finishing block in accordance with the invention, FIG. 4 is a partially sectioned plan view of part of the finishing block shown in FIG. 3, FIG. 5 is a partially sectioned elevation on the line AA of FIG. 4 and FIG. 6 is a partially sectioned axial elevation of a four strand finishing block viewed along its axis.

Comparing FIG. 2 with FIG. 1, it can be seen that the parent bar 1 usually a steel bar is slit into two strands as it leaves the last stand of the intermediate mill. The two daughter strands pass along separate finishing lines 5, 5' which include respective guide tubes 4, 4'. The finishing block 12 comprises three finishing block units in tandem each of which provides two pairs of rolls for each strand. The two pairs of rolls provided by each unit for each strand have their axes mutually at right angles. All of the rolls of all three finishing block units are in driving relation with a common drive shaft 13 which is driven by a motor 14. The axis of the drive shaft 13 is between and spaced from the two parallel paths of the finishing lines. After the two strands are rolled simultaneously in the finishing block 12, the two strands converge through guide tubes 11, 11' and continue side-by-side downstream for further treatment.

It can be seen from a comparison of FIGS. 1 and 2, that the finishing line employing the twin strand finishing block embodying the invention is shorter and less wide than the prior art finishing line of FIG. 1. In a particular installation, a finishing line having the form shown in FIG. 1 has a length of approximately 50 meters, and an installation including a finishing block in accordance with the present invention is approximately 30 m long.

Referring to FIG. 3, two twin strand units 12A, 12B of a twin strand finishing block are shown.

The first unit 12A comprises a pair of rolls 15V arranged with their axes substantially vertical. Downstream there is a pair of rolls 15H arranged with their axes substantially horizontal. One daughter strand passes along the path 5 successively between the rolls 15V and 15H to be reduced in cross-section. Similarly, another daughter strand passes along the path 5' successively between a pair of horizontal rolls 16H and a pair of vertical rolls 16V. The two paths taken by the strands are on opposite sides of a further path 17 on which a drive shaft 18 lies. This drive shaft is in driving relation with all of the rolls 15V, 15H, 16V and 16H. The drive shaft is connected to a motor 19 which has its longitudinal axis along the further path. As shown in FIG. 3, two or more motors arranged in series may be employed.

A second unit 12B is arranged downstream of first unit 12A and is identical with unit 12A in that it provides a pair of horizontal rolls 20H and a pair of vertical rolls 20V for each strand. The finishing block units 12A, 12B are connected together mechanically on the further path 17 so that all the rolls of the unit 12B are driven by the motor 19. Although the rolls 15, 16 and 20 have been described as having their roll axes vertical or horizontal, the axes need not be horizontal or vertical but the axes of each pair of rolls are mutually at right angles to the preceding and succeeding pairs of rolls.

As shown in FIGS. 4 and 5, the common drive for all the rolls of the first unit 12A comprises an input drive shaft 18 lying below a pass line "P" of the parent bar. The input drive shaft 18 is coupled at its downstream end to the upstream end of an input drive shaft of the second twin strand unit 12B. It will be appreciated that any number of twin strand units can be conveniently coupled together in series. Also, worn or failed twin strand units can be easily removed for maintenance and subsequently replaced.

A left hand input bevel gear 21L and a right hand input bevel gear 21R are mounted facing opposite each other on the input drive shaft 18. The left hand bevel gear 21L couples the input drive shaft 18 a mechanical transmission which is coupled to the pairs of rolls 16V and 16H on the left hand side of the drive shaft. The right hand bevel gear 21R is similarly coupled to a mechanical transmission for driving rolls 15H and 15V on the right hand side of the drive shaft. The components of the transmission on the right hand side are similar to those of the transmission on the left hand side and so for the sake of conciseness only the components of the transmission on the left hand side will be described.

The left hand bevel gear 21L is meshed with an output bevel gear, i.e. a transmission bevel gear 22L which is mounted upon one end of a drive shaft 23L, extending at right angles away from the input drive shaft 18. The left drive shaft 23L may be inclined upwardly as shown in FIG. 5 and is supported in a pair of spaced bearings 24L. A first spur gear 25L is mounted on the drive shaft 23L between the pair of bearings 24L. A first bevel gear assembly 26L is coupled to the end of the drive shaft 23L to turn the drive through ninety degrees in order to couple the drive shaft to a first drive shaft 27L which is inclined downwardly from the bevel gear assembly 26L to minimise the width of the twin strand finishing block. The bottom end of the first drive shaft 27L is coupled with a second drive shaft 28L by means of a second spur gear assembly whereby the rolls 16V are coupled to the drive motor.

The first spur gear 25L is meshed with a third spur gear 29L which is mounted on a drive shaft, which, by means of a gear box 30L couples the horizontal rolls 16H to the drive motor.

It will be noted that the two finishing lines, comprising the two roll stands and their transmission from the shaft 18 are similar except for their position.

By inclining the left and right drive shafts of the transmission in the way described space, is provided above the axis of the twin strand finishing block along the pass line "P" to allow a parent bar to pass directly through the twin strand finishing block avoiding the rolls 15 and 16.

The basic concept of the present invention allows the twin-strand finishing block structure to be readily extended to three, four or even more parallel strand finishing block structure each finishing line being coupled to the drive motor 19 by way of its input bevel gear 21 mounted on the input drive shaft 18 and a transmission bevel gear 22.

The second embodiment illustrates a four strand finishing block having four finishing lines disposed radially around a horizontal path provided by the input drive shaft 18. Two opposing input bevel gears 21 are mounted on the input drive shaft 18 in the same way as the first embodiment. In FIG. 6 only the downstream input bevel gear 21 is shown because of the section. The transmission bevel gears 22 of two radially opposite finishing lines are meshed with the downstream input bevel gear 21 to couple the upper right and the lower left finishing lines to the drive shaft 18. The upper left and lower right twin roll finishing lines are similarly coupled to the downstream input bevel gear. Each finishing line is similar to the finishing line described in respect of the first embodiment.

A similar drive, driven from a common drive source, can be provided for a three strand finishing block.

What is claimed is:

1. A finishing line for rolling at least two stands of bar simultaneously and comprising for each of the strands a multiplicity of pairs of rolls arranged in tandem with the rolls of each pair being at right angles of those of the or each pair adjacent to it, said pairs of rolls being provided by at least two similar finishing blocks arranged in tandem with each block providing for each strand two of said pairs of rolls arranged mutually at right angles, each block having a single drive shaft in driving relation with all the pairs of rolls of the block and said drive shafts of said blocks being releasably connected in series to a common drive means.

2. A finishing block as claimed in claim 1 characterised in that the strands of bar extend along separate parallel paths (5, 5') spaced from a further path (17) and the axis of the shaft (18) is located on said further path (17).

3. A finishing block as claimed in claim 2 in which there are four parallel paths and two of said parallel paths are at a lower level than said further path.

* * * * *